US009730529B2

(12) United States Patent
Colelli et al.

(10) Patent No.: US 9,730,529 B2
(45) Date of Patent: Aug. 15, 2017

(54) UNIVERSAL MERCHANDISING SYSTEM

(71) Applicant: Displays Plus, Inc., Placentia, CA (US)

(72) Inventors: Robert Paul Colelli, Yorba Linda, CA (US); Eric Edward Oberg, Huntington Beach, CA (US); Johnnie Cruz, Anaheim Hills, CA (US)

(73) Assignee: DISPLAYS PLUS, INC., Placentia, CA (US)

( * ) Notice: Subject to any disclaimer, the term of this patent is extended or adjusted under 35 U.S.C. 154(b) by 0 days.

(21) Appl. No.: 15/345,450

(22) Filed: Nov. 7, 2016

(65) Prior Publication Data

US 2017/0127853 A1 May 11, 2017

Related U.S. Application Data

(60) Provisional application No. 62/252,305, filed on Nov. 6, 2015.

(51) Int. Cl.
*A47F 1/12* (2006.01)
*A47F 5/00* (2006.01)

(52) U.S. Cl.
CPC ..... *A47F 1/126* (2013.01); *A47F 5/005* (2013.01); *A47F 5/0025* (2013.01)

(58) Field of Classification Search
CPC ..... A47F 1/126; A47F 5/0025; A47F 5/005; A47F 1/125; A47F 7/28
USPC ..... 211/59.3
See application file for complete search history.

(56) References Cited

U.S. PATENT DOCUMENTS 5,360,122 A * 11/1994 Benton ..... B65G 1/023 211/151
5,845,794 A * 12/1998 Highsmith ..... A47B 96/1441 211/151
2015/0157142 A1* 6/2015 Turner ..... A47F 1/125 211/59.3
2015/0173529 A1* 6/2015 Hester-Redmond ..... A47F 5/08 211/59.3
2015/0289683 A1* 10/2015 Walker ..... A47F 5/005 211/59.3

* cited by examiner

*Primary Examiner* — Korie H Chan
(74) *Attorney, Agent, or Firm* — Vista IP Law Group LLP

(57) ABSTRACT

A merchandising system includes slotted cross members connected by side brackets to form a shelf component. Various accessories are insertable into the slots of the cross members to form organizational components along the shelf.

10 Claims, 6 Drawing Sheets

UNIVERSAL MERCHANDISING SYSTEM

CROSS-REFERENCE TO RELATED APPLICATIONS

This application claims the benefit of U.S. provisional Application No. 62/252,305 filed on Nov. 6, 2015, in accordance with 35 U.S.C. Section 119(e), and any other applicable laws. The contents of the aforementioned application(s) are hereby incorporated herein by reference in their entirety as if set forth fully herein.

BACKGROUND

The metal shelf has been the back bone of brick and mortar retail stores for almost a century. Today, merchandise is still placed onto the shelf. Some unique shelves have been developed, such as the angled shelf and the rolling shelf which are still just shelves for merchandise to be placed on. Most all recent merchandising breakthroughs have involved placing different apparatus on top of the shelf to organize products better. Spring fronting devices known as pusher systems along with dividers are available in various styles. In essence, additional fixtures are added to the shelf to segregate and forward merchandise. This adds another level of fixture on fixture. There is thus a need for a universal merchandising system which incorporates both the shelving and organizing aspects of displays into a single unit.

SUMMARY OF THE INVENTION

The present invention embodies a new approach to merchandising that consolidates the shelf and organizing system into one unit, thus minimizing the number of parts. Fewer parts are better environmentally, and also lower shipping and fixture costs. Components are shipped in smaller cartons and are assembled without tools in minutes.

DRAWINGS

Figure 1:
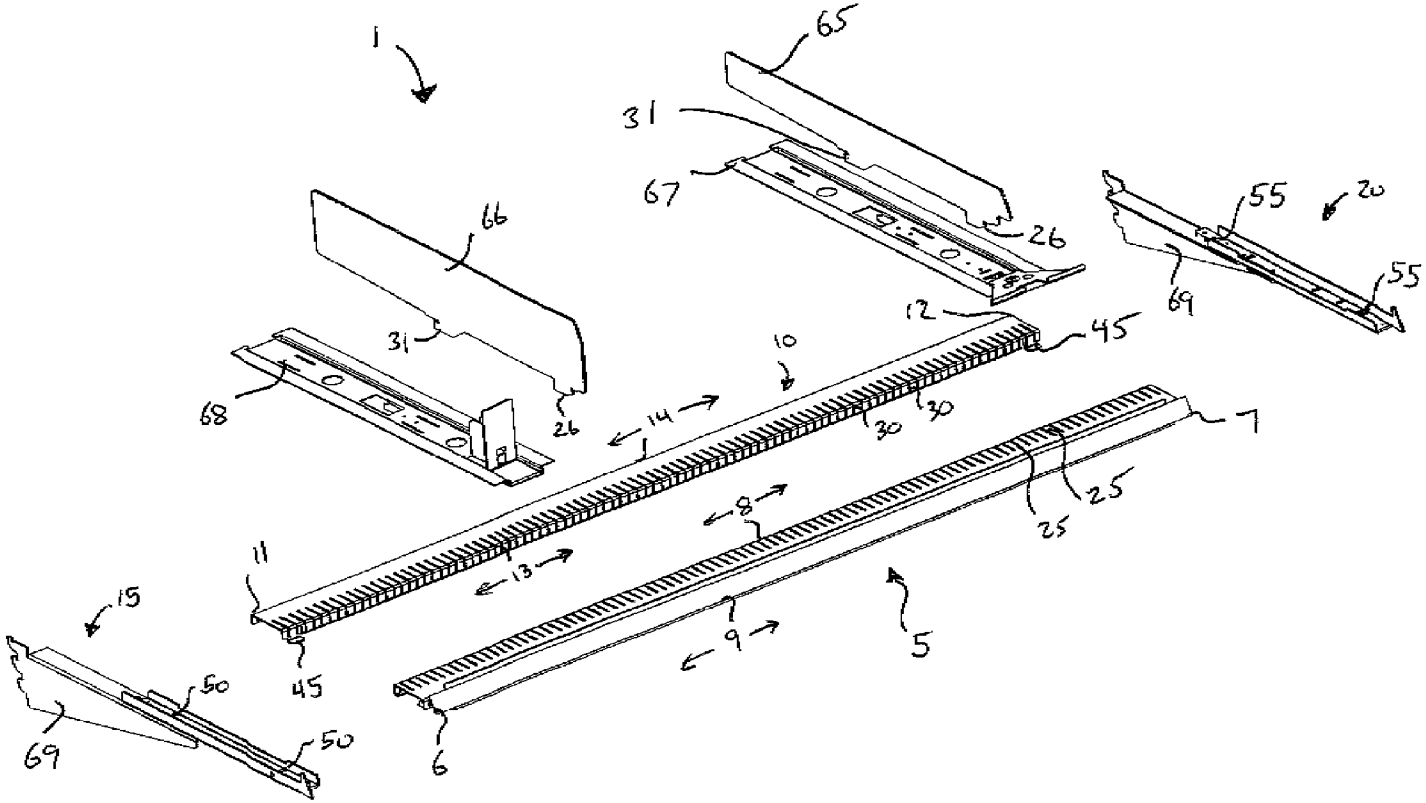

FIG. 1 shows an exploded view of a merchandising system in accordance with an embodiment of the present invention, with some accessories.

Figure 2B:
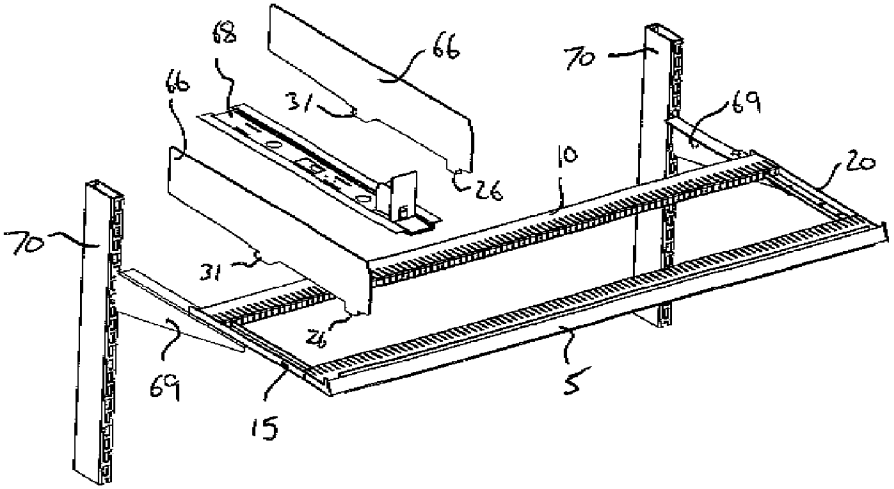
Figure 2A:
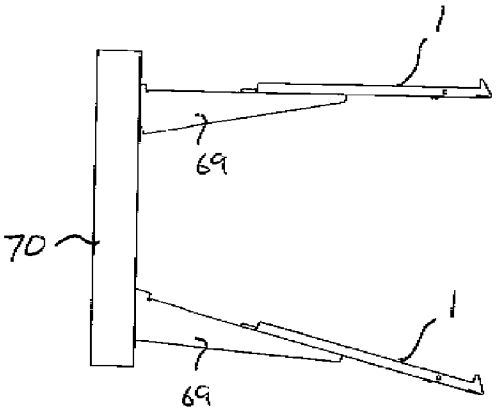

FIG. 2*a* shows the merchandising system of FIG. 1 (without the accessories) attached to a gondola at a level arrangement and at an angled arrangement.

FIG. 2*b* shows a closer view of the level-mounted merchandising system of FIG. 2*a*, with some accessories.

Figure 3:
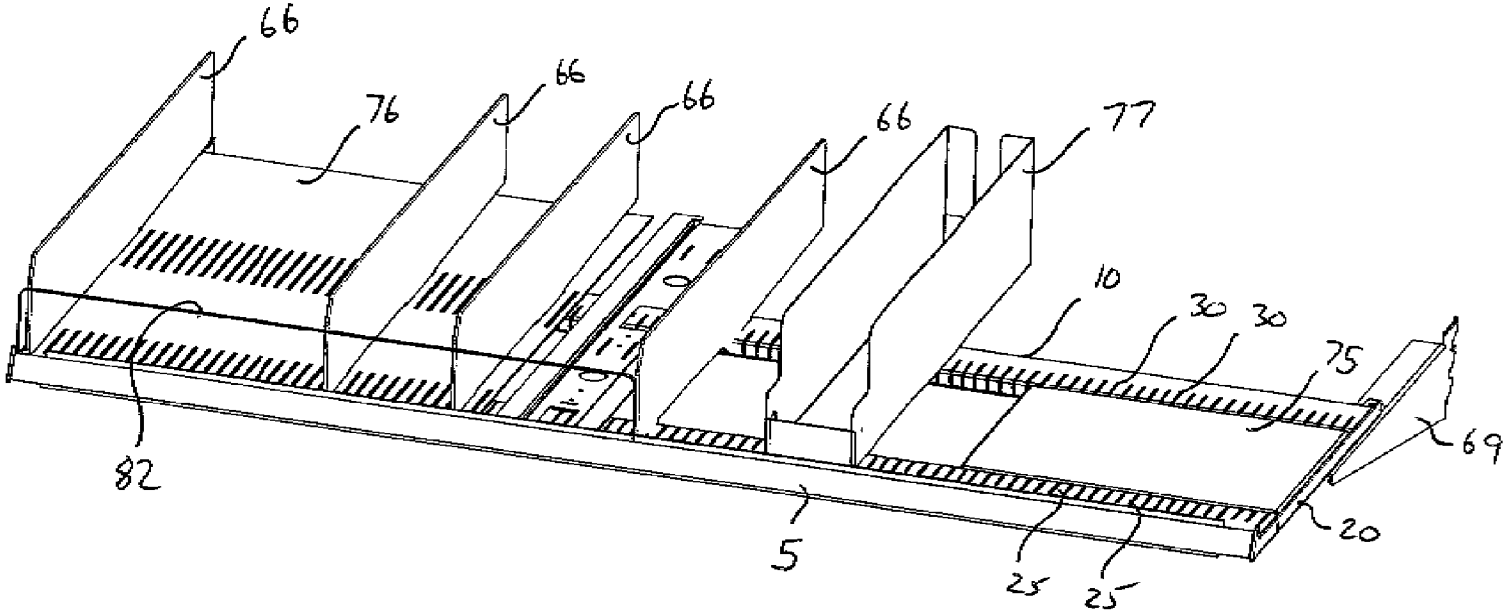

FIG. 3 shows the merchandising system of FIG. 1 assembled, with various accessories.

Figure 4A:
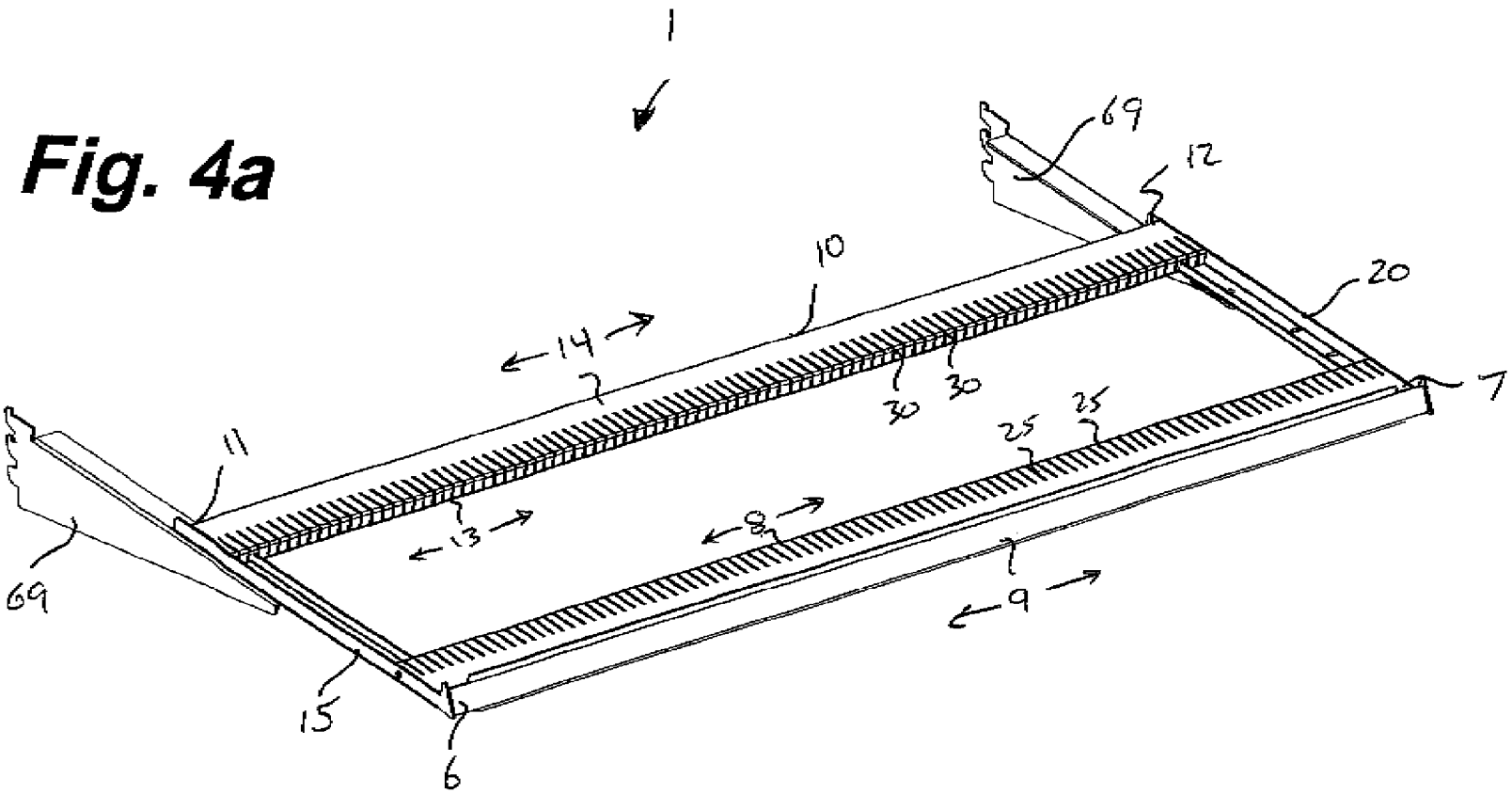

FIG. 4*a* shows the merchandising system of FIG. 1 assembled, with no accessories.

Figure 4B:
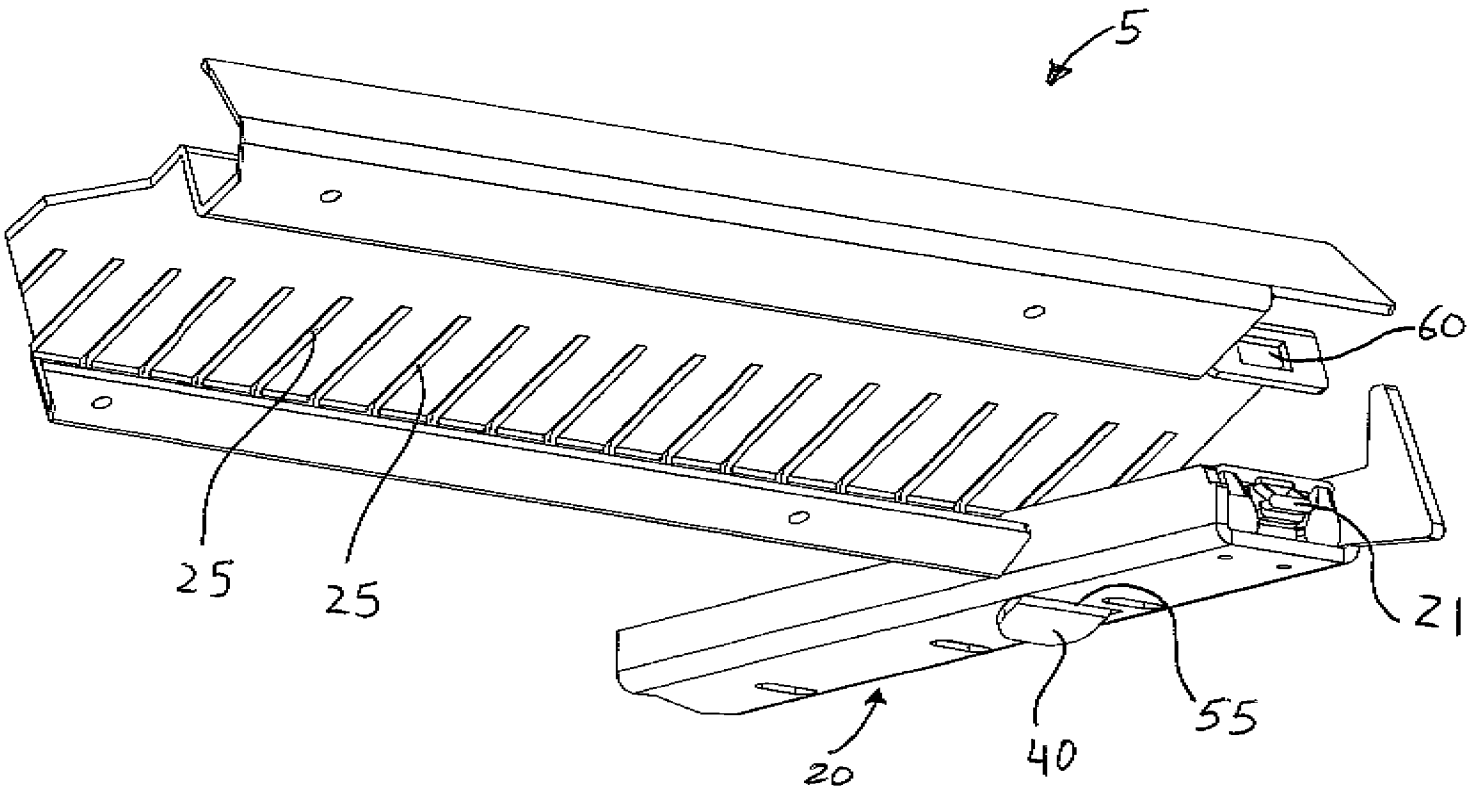

FIG. 4*b* shows a close up of the front cross member of FIG. 4*a* being removably secured to the right side bracket.

Figure 5:
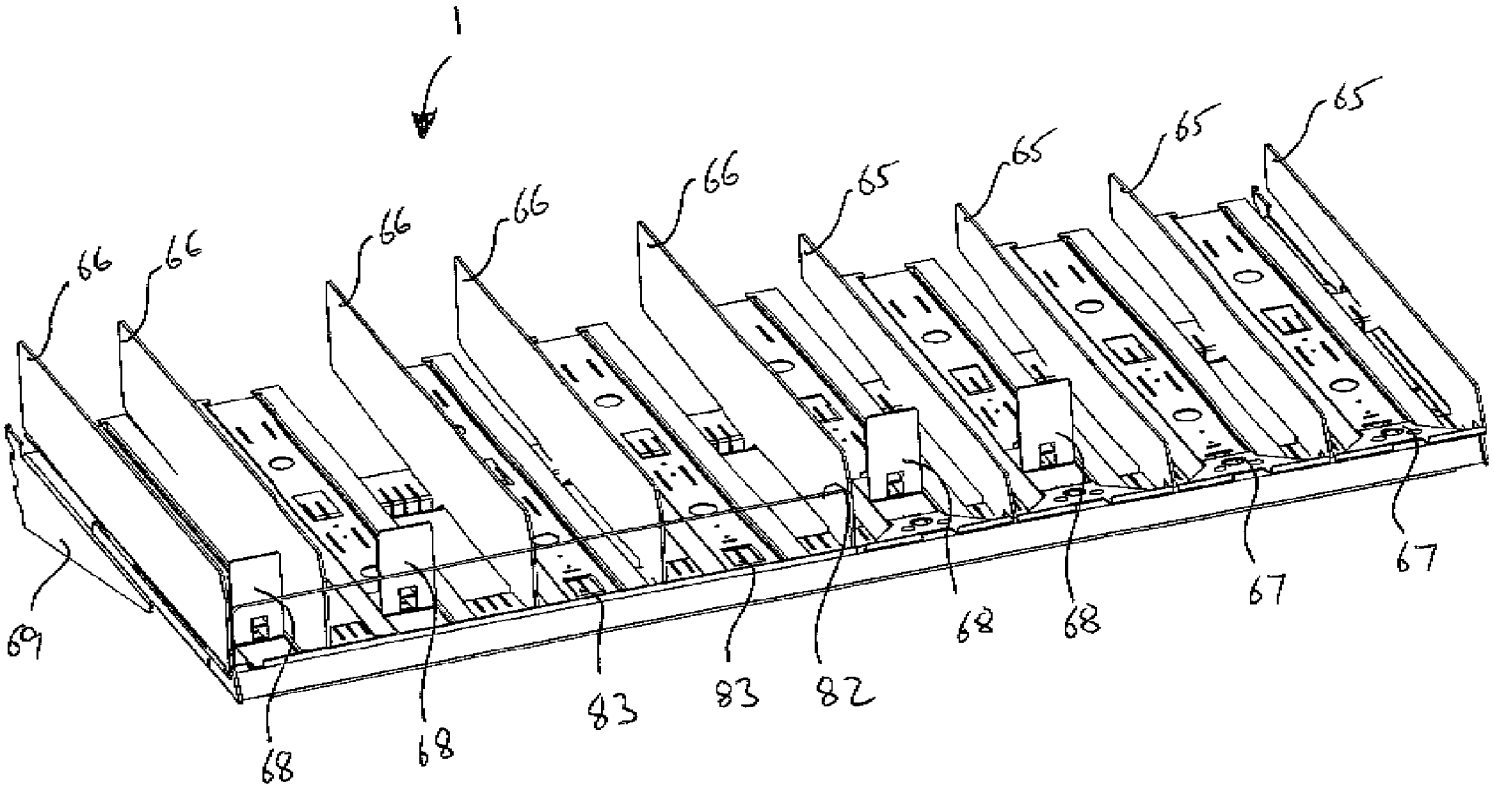

FIG. 5 shows the merchandising system of FIG. 1 assembled, with all available shelf space allocated to various accessories.

DETAILED DESCRIPTION

The universal merchandising system (1) of the present invention includes a front cross member (5) and a back cross member (10) both removably attached to a left side bracket (15) and right side (20) bracket, as best seen in FIG. 4*a*. The cross members (5, 10) are slotted (25, 30) to accommodate various accessories (e.g., short dividers (65), tall dividers (66), gravity feeders (67), pushers (68), platforms (75), slotted platforms (76), bins (77), and/or other accessories as known in the art) to form organizational components along what appears as a traditional shelf. The slots (25, 30) are typically evenly distributed along the respective edges.

An assembled universal merchandising system (1) in accordance with an embodiment of the present invention is shown in FIG. 4*a*. Typically the system (1) is secured to a gondola, wall, or other structure (70) by structure brackets (69) as is known in the art. This is shown in FIG. 2*a*, which shows one system (1) attached in a level arrangement at the top, and another system (1) attached in an angled arrangement at the bottom.

The front cross member (5) has a left side (6), a right side (7), an inwardly-facing edge (8), and an outwardly-facing edge (9). Similarly, the back cross member (10) has with a left side (11), a right side (12), an inwardly-facing edge (13), and an outwardly-facing edge (14). The inwardly-facing edge (8) of the front cross member (5) has inwardly-facing slots (25) therealong for receiving front catches (26) of removable accessories. Similarly, the inwardly-facing edge (13) of the back cross member (10) has inwardly-facing slots (30) therealong, aligned with the inwardly-facing slots (25) of the front cross member (5), for receiving back catches (31) of the removable accessories. As used herein, "inwardly facing" refers to the direction facing towards the inside of the system, i.e., where merchandise will be placed. Thus, the inwardly-facing slots (25) and (30) face each other. Conversely, "outwardly-facing" refers to the direction facing away from the inside of the system. For the front cross member (5), that is in a direction out in front of the system (1). For the back cross member (10), that is in a direction out in back of the system (1).

The cross members (5, 10) are connected to left and right side brackets (15 and 20 respectively) using a first set of tabs (40) and slots (55) and a second set of tabs (21) and slots (60) for each of the front right, front left, back right, and back left corners of the system (1). This is best seen in FIG. 4*b* which shows the attachment point of the front cross member (5) to the right side bracket (20). Using this front right corner as an example, the cross member (5) is first mated with the right side bracket (20) via inwardly-facing tab (40) on the cross member (5) and slot (55) on the right side bracket (20). Next, the cross member (5) is rotated such that a slot (60) in the cross member (5) engages a locking tab (21) attached to right side bracket (20). This is similarly repeated for the front left corner, the back left corner, and the back right corner, all in any sequence. The cross members (5, 10) are thus removably secured to the side brackets (15, 20), as shown in FIG. 4*a*.

FIG. 2*b*, this shows a system (1) attached to a gondola (7) in a level position. Dividers (66) and pusher (68) are shown in an exploded view. They would be attached to the front slots (25) via front catches (26), and to the back slots (30) via back catches (31). FIG. 3 shows a system (1) with various accessories implemented. For example, a slotted platform (76) may sit directly on the cross members (5) and (10) to allow dividers (66) to be installed to segregate the merchandised product. A front fence (82) may also be installed to retain the merchandised product on the system. A non-slotted platform (75) may be used to allow for conventional merchandising of various products. A self-contained tray or bin (77) is another optional component that can be attached to system (1). The tray (77) may include any combination of retaining walls or barriers on any side, top, or bottom.

Turning now to FIG. 5, a completely assembled version of the system (1) I shown using various components to utilize all available "shelf space." These components include tall dividers (66), short dividers (65), pusher tracks (68), basic tracks (83), gravity tracks (67), and a front fence (82). Another option not shown is a feature to communicate sales, brand or seasonal messages graphically and/or electronically. This may be done as is known in the art, and provisions may be included to accept Omni-channel digital edge technology by CLOVERLEAF. Inventory control, targeted marketing and advertising revenue streams are a few of the many benefits obtained with CLOVERLEAF and can be easily integrated into the system of the present invention.

What is claimed is:

1. A merchandising system (1) comprising:

a front cross member (5) with a left side (6), a right side (7), an inwardly-facing edge (8), and an outwardly-facing edge (9);

a back cross member (10) with a left side (11), a right side (12), an inwardly-facing edge (13), and an outwardly-facing edge (14);

a left side bracket (15) having a front tab and a back tab, and connecting the front cross member to the back cross member along the left sides thereof; and a right side bracket (20) having a front tab (21) and a back tab, and connecting the front cross member to the back cross member along the right sides thereof;

wherein the inwardly-facing edge of the front cross member has inwardly-facing slots (25) therealong for receiving front catches (26) of removable accessories;

wherein the inwardly-facing edge of the back cross member has inwardly-facing slots (30) therealong, aligned with the inwardly-facing slots of the front cross member, for receiving back catches (31) of the removable accessories;

wherein the inwardly-facing edge of the front cross member has inwardly-facing tabs (40) at the right and left sides thereof;

wherein the inwardly-facing edge of the back cross member has inwardly-facing tabs (45) at the right and left sides thereof;

wherein the inwardly facing tab at the left side of the front cross member and the inwardly facing tab at the left side of the back cross member are removably secured into slots (50) in the left side bracket;

wherein the inwardly facing tab at the right side of the front cross member and the inwardly facing tab at the right side of the back cross member are removably secured into slots (55) in the right side bracket;

wherein the outwardly-facing edge of the front cross member has slots (60) at the right and left sides thereof;

wherein the outwardly-facing edge of the back cross member has slots at the right and left sides thereof;

wherein the front tab of the left side bracket is removably secured into the slot at the left side of the outwardly-facing edge of the front cross member;

wherein the front tab of the right side bracket is removably secured into the slot at the right side of the outwardly-facing edge of the front cross member;

wherein the back tab of the left side bracket is removably secured into the slot at the left side of the outwardly-facing edge of the back cross member; and wherein the back tab of the right side bracket is removably secured into the slot at the right side of the outwardly-facing edge of the back cross member.

2. The merchandising system of claim 1, further comprising a platform (75) removably secured between the front cross member and the back cross member to form a shelf.

3. The merchandising system of claim 2, wherein the platform is a slotted platform (76), and the slots therein align with corresponding inwardly-facing slots of the front cross member and inwardly-facing slots of the back cross member.

4. The merchandising system of claim 1, wherein inwardly-facing slots along the inwardly-facing edge of the front cross member are evenly distributed along said edge.

5. The merchandising system of claim 4, wherein inwardly-facing slots along the inwardly-facing edge of the back cross member are evenly distributed along said edge.

6. The merchandising system of claim 1, wherein the system is attached to a secured structure by structure brackets (69).

7. The merchandising system of claim 1, further comprising a pusher (68) removably secured to the front cross member in a first one of the inwardly-facing slots thereof, and to the back cross member in a correspondingly-aligned first one of the inwardly-facing slots thereof.

8. The merchandising system of claim 7, further comprising a divider (65 or 66) removably secured to the front cross member in a second one of the inwardly-facing slots thereof, and to the back cross member in a correspondingly-aligned second one of the inwardly-facing slots thereof.

9. The merchandising system of claim 1, further comprising a gravity feed device (67) removably secured to the front cross member in a first one of the inwardly-facing slots thereof, and to the back cross member in a correspondingly-aligned first one of the inwardly-facing slots thereof.

10. The merchandising system of claim 9, further comprising a divider (65 or 66) removably secured to the front cross member in a second one of the inwardly-facing slots thereof, and to the back cross member in a correspondingly-aligned second one of the inwardly-facing slots thereof.

* * * * *